US011045067B2

(12) United States Patent
Dreossi et al.

(10) Patent No.: US 11,045,067 B2
(45) Date of Patent: Jun. 29, 2021

(54) DISHWARE SUPPORTING ARRANGEMENT AND DISHWASHER COMPRISING DISHWARE SUPPORTING ARRANGEMENT

(71) Applicant: ELECTROLUX APPLIANCES AKTIEBOLAG, Stockholm (SE)

(72) Inventors: Giuseppe Dreossi, Stockholm (SE); Anna Delin, Stockholm (SE); Marie Hakkarainen, Stockholm (SE); David Persson, Stockholm (SE)

(73) Assignee: Electrolux Appliances Aktiebolag

( * ) Notice: Subject to any disclaimer, the term of this patent is extended or adjusted under 35 U.S.C. 154(b) by 52 days.

(21) Appl. No.: 16/339,622

(22) PCT Filed: Oct. 19, 2016

(86) PCT No.: PCT/EP2016/075014
§ 371 (c)(1),
(2) Date: Apr. 4, 2019

(87) PCT Pub. No.: WO2018/072818
PCT Pub. Date: Apr. 26, 2018

(65) Prior Publication Data

US 2020/0037846 A1 Feb. 6, 2020

(51) Int. Cl.
*A47L 15/48* (2006.01)
*A47L 15/50* (2006.01)

(52) U.S. Cl.
CPC ..... *A47L 15/48* (2013.01); *A47L 15/505* (2013.01)

(58) Field of Classification Search
CPC ..... A47L 15/48; A47L 15/503; A47L 15/504; A47L 15/505
USPC ..... 134/95.2; 211/150
See application file for complete search history.

(56) References Cited

U.S. PATENT DOCUMENTS

2011/0247990 A1* 10/2011 Chai ..... A47L 15/503 211/150

FOREIGN PATENT DOCUMENTS

| | | | |
|---|---|---|---|
| CN | 201 286 692 | Y | 8/2009 |
| CN | 204 618 156 | U | 9/2015 |
| DE | 10 2011 003774 | A1 | 8/2012 |
| EP | 2 074 925 | A1 | 7/2009 |

(Continued)

OTHER PUBLICATIONS

CN201286692Y—Machine translation (Year: 2009).*
International Search Report and Written Opinion for Application No. PCT/EP2016/075014 dated Oct. 19, 2016, 10 pages.

*Primary Examiner* — Tinsae B Ayalew
(74) *Attorney, Agent, or Firm* — RatnerPrestia

(57) ABSTRACT

A dishware supporting arrangement is provided that may include a mesh structure and a tilting mechanism. The mesh structure may include a structure main extension plane and may include a first plurality of ribs connected to a second plurality of ribs. The first plurality of ribs may extend along a first plane at a first angle and the second plurality of ribs may extend along a second plane at a second angle. The tilting mechanism may allow the mesh structure to be titled around at least one axis between a first position and a second position and may hold the mesh structure in the first position and in the second position. Each of the first plurality of ribs and each of the second plurality of ribs may be inclined in relation to the rack main extension plane at the first position and at the second position.

11 Claims, 4 Drawing Sheets

(56) References Cited

FOREIGN PATENT DOCUMENTS

WO WO 2010/062195 A1 6/2010

* cited by examiner

DISHWARE SUPPORTING ARRANGEMENT AND DISHWASHER COMPRISING DISHWARE SUPPORTING ARRANGEMENT

CROSS-REFERENCE TO RELATED APPLICATIONS

This application is a national stage application filed under 35 U.S.C. § 371 of International Application No. PCT/EP2016/075014 filed Oct. 19, 2016, which application is hereby incorporated by reference herein in its entirety.

TECHNICAL FIELD

Embodiments herein relate to dishwashers and accessories therefor. In particular, the embodiments herein relate to a dishware supporting arrangement and a dishwasher comprising a dishware supporting arrangement.

BACKGROUND

Today's dishwashers are expected to perform high quality wash of dishware while at the same time use a relatively small amount of energy in order to account for environmental concerns. It is also expected that washed dishware, such as items, plates, glasses, silverware etc., are dry after a program cycle of a dishwasher. The program cycle usually comprises a washing phase and a drying phase. In the last step of the washing phase, fresh water is sprayed at the dishware in order to rinse off detergent from the washed dishware. After the washing phase, water-drops and pools of water are usually formed on the washed items and on racks and shelves inside the dishwasher due to surface tension. Before the drying phase starts, the interior of the dishwasher is typically heated to cause remaining water to evaporate. This is achieved by heating up the dishware with hot water in a hot rinse phase. After that hot air may be blown in to dry the dishware using heaters arranged within the dishwasher and/or by blowing into the dishwasher. The remaining water will then evaporate and the size of the water-drops will be gradually reduced.

One problem with today's dishwashers is that some water-drops may remain on the surfaces of for example the shelves and may not be completely evaporated during the drying phase. Disadvantageously, the water-drops may fall down on dry dishware when the shelves and/or the racks are displaced, e.g. when the washed dishware is to be moved into a closet or the like.

SUMMARY

An object of the embodiments herein is to provide an improved dishware supporting arrangement, such as a shelf of a dishwasher mentioned above, that overcomes or at least alleviates at least some of the above mentioned problem and/or disadvantages.

According to an aspect of the invention, the object is achieved by a dishware supporting arrangement configured to be mounted on a rack of a dishwasher, the rack having a rack main extension plane. The dishware supporting arrangement comprises a mesh structure having a structure main extension plane, wherein the mesh structure comprises a first plurality of ribs connected to a second plurality of ribs. The first plurality of ribs extends along a first plane and the second plurality of ribs extends along a second plane. In other words, the first plurality of ribs extends along the first plane in that the first plurality of ribs extends in directions within the first plane or in directions being parallel to the first plane, but at a distance from the first plane. In a similar way the second plurality of ribs extends in a second direction parallelly orientated in relation to the second plane and within the second plane or at a distance from the second plane. The first plane is arranged at a first angle in relation to the structure main extension plane and the second plane is arranged at a second angle in relation to the structure main extension plane. Thereby, the first plurality of ribs are inclined in relation to the structure main extension plane with the first angle and the second plurality of ribs are inclined in relation to the structure main extension plane with the second angle.

The dishware supporting arrangement further comprises a tilting mechanism arranged to allow the mesh structure to be tilted around at least one axis between a first position and a second position. The mesh structure may thereby be at least partly rotated around the at least one axis. In this manner, the mesh structure may easily be displaced between the first position and the second position.

Further, the tilting mechanism is arranged to hold the mesh structure in the first position and in the second position. Thus, when the mesh structure is displaced to the first position, the mesh structure is stabilized, e.g. snapped into, in the first position by means of the tilting mechanism. Similarly, when the mesh structure is displaced to the second position, the mesh structure is stabilized in the second position by means of the tilting mechanism.

Each of the first plurality of ribs and each of the second plurality of ribs are inclined in relation to the rack main extension plane at the first position and at the second position. Thereby, at the first and second positions of the mesh structure, each rib of the first plurality of ribs and each rib of the second plurality of ribs are inclined with respect to the rack main extension plane. Thanks to that the rack main extension plane usually extends along a horizontal plane when the rack is mounted inside a dishwasher, while assuming the dishwasher to be placed in a normal operating position, each rib of the first plurality of ribs and each rib of the second plurality of ribs are inclined, i.e. are angled, in relation to the horizontal plane at the first position and at the second position. Thereby, none of the first plurality of ribs and none of the second plurality of ribs are parallel in relation to the horizontal plane at the first position and at the second position during use of the dishwasher.

As mentioned, a washing fluid, such as washing liquid or water or mixture of the washing liquid and the water, may form droplets or pools on the dishware supporting arrangement. Since each of the first plurality of ribs and each of the second plurality of ribs are inclined in relation to the horizontal plane at the first position and at the second position, the washing fluid, such as water-drops, droplets, pools or the like, flows along the first plurality of ribs and the second plurality of ribs downwards due to gravity. In some situations, washing fluid droplets meets other droplets on their way downwards. Thus, resulting in bigger droplets that may more easily fall off, or separate from, the mesh structure compare to when the first plurality of ribs and the second plurality of ribs are horizontally oriented.

Thus, an improved dishware supporting arrangement is achieved that improves draining, i.e. running off of washing fluid from the dishware supporting arrangement during a programmed cycle of a dishwasher.

As a result, the above mentioned object is achieved.

According to some embodiments, the structure main extension plane is arranged at a third angle in relation to the rack main extension plane at the first position. Likewise, the structure main extension plane is arranged at a fourth angle in relation to the rack main extension plane at the second position. The fourth angle is greater than the third angle.

Thus, at the first position the structure is less inclined in relation to the rack main extension plane compare to the second position.

Optionally, the first angle and the second angle are less than the third angle. Thus, each rib of the first plurality of ribs and each rib of the second plurality of ribs are inclined in relation to the rack main extension plane at the first position and at the second position and at all positions between the first position and the second position.

According to some embodiments, the mesh structure is arranged to support dishware at the first position. Thus, at the first position, the dishware may be placed on the mesh structure.

Further, the mesh structure may comprise a supporting side adapted to support the dishware, wherein each rib of the first plurality of ribs and each rib the second plurality of ribs has a cross sectional profile comprising a tip pointing oppositely to a direction from the support side and away from the support side. This direction being referred to as "normal direction" of the mesh structure. With other words the tip is pointing in a direction downward while assuming the dishwasher to be placed in a normal operating position. Thereby, droplets of washing fluid that are collected on the mesh structure flows downwards and ends up at the tip. Thanks to the tip, the droplets that end up at the tip have a smaller contact area with the first plurality of ribs and with the second plurality of ribs as compared to when the cross sectional profile has an even horizontal side on that side of the cross sectional profile that is opposite to the normal direction. Consequently, forces keeping the droplets at the ribs are reduced and thereby the droplets fall off, or separates from, the ribs more easily.

According to some embodiments, the cross sectional profile is shaped as a rhomb.

The mesh structure may comprise a plastic material. Thereby, a mesh structure is achieved that:—has low weight,—is suitable for an environment with a lot of water, and—is easy and cheap to manufacture.

Further, a projection of the first plurality of ribs and the second plurality of ribs onto a plane perpendicularly orientated with respect to the at least one axis may be described by a zig-zag pattern.

According to another aspect of the embodiments herein, the object is achieved by a dishwasher comprising a dishware supporting arrangement according to the embodiments herein.

Further features of, and advantages with, the present invention will become apparent when studying the appended claims and the following detailed description. Those skilled in the art will realize that the different features described may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The embodiments herein will now be described more fully with reference to the accompanying drawings, in which example embodiments are shown. Disclosed features of example embodiments may be combined. Like numbers refer to like elements throughout. Well-known functions or constructions will not necessarily be described in detail for brevity and/or clarity.

Figure 1:
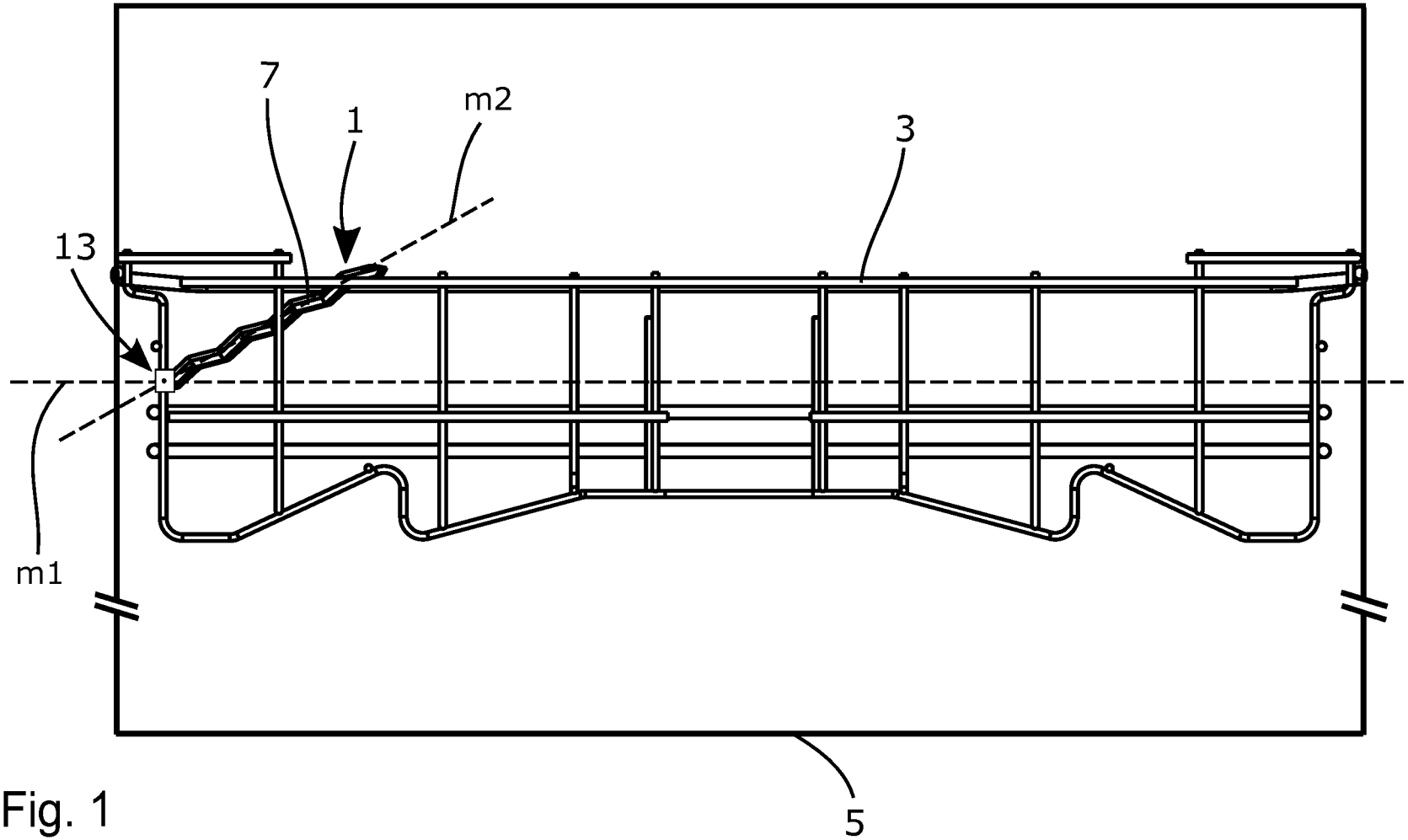
FIG. 1 is a perspective view illustrating an exemplifying dishwasher comprising a rack and a dishware supporting arrangement.

FIG. 1 illustrates a dishware supporting arrangement 1 arranged on a rack 3. The rack 3 is arranged within an interior of a dishwasher 5. The rack 3 is mounted in the dishwasher 5 in a known manner, and therefore not described in detail. The rack main extension plane m1 is a plane in which the rack 3 substantially extends and along which the rack 3 is displaceable, e.g. in a typical case of an upper rack, in and out of the dishwasher 5 for facilitating removal and insertion of dishware onto the rack 3. If a position of the rack 3 within the dishwasher 5 or outside of the dishwasher 5 is changed, a change of a position of the rack main extension plane m1 occurs as a consequence thereof. When the dishwasher 5 is placed in a normal operating position, the rack main extension plane m1 coincides with a horizontal plane.

As illustrated in FIG. 1, the dishware supporting arrangement 1 comprises a mesh structure 7 having a structure main extension plane m2. The structure main extension plane m2 extends along a plane in which the mesh structure 7 substantially extends. The mesh structure 7 may comprise, e.g. be made of, a plastic material as for example a polymer, or coated steel. The mesh structure 7 may be manufactured in one piece, for example by molding.

Figure 3:
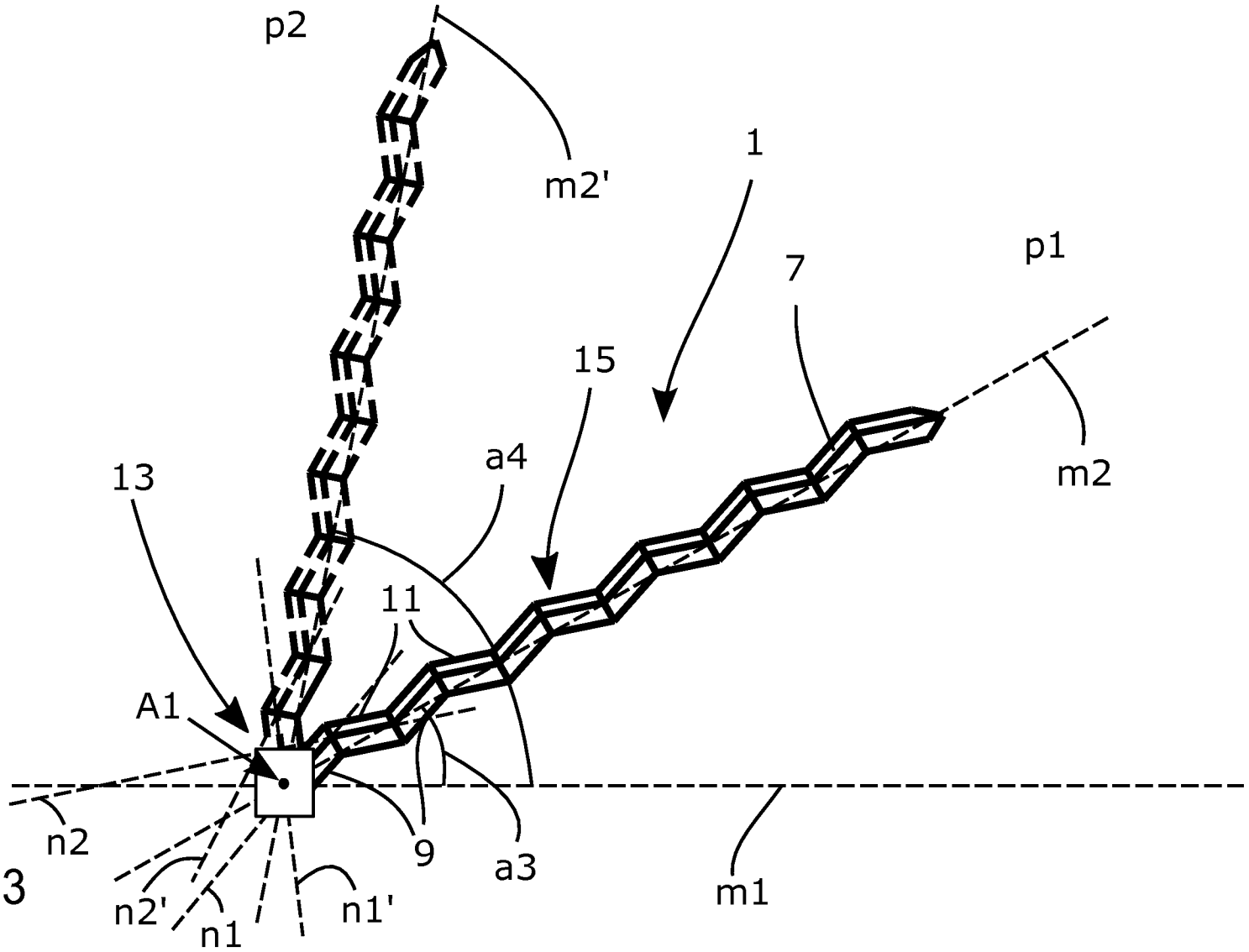
FIG. 3 is another plan view illustrating the dishware supporting arrangement of FIG. 1 with the mesh structure of FIGS. 2*a* and 2*b* in two different positions.

The dishware supporting arrangement 1 according to FIG. 1 comprises a tilting mechanism 13 arranged to allow the mesh structure 7 to be titled around at least one axis between a first position and a second position described in detail in conjunction with FIG. 3.

Figure 2A:
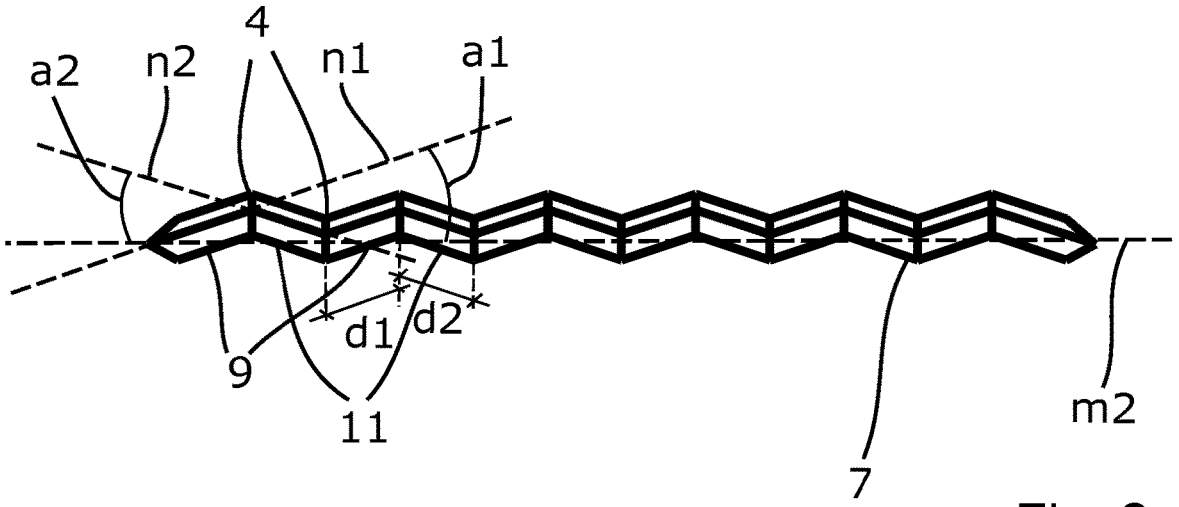
FIG. 2*a* is a plan view illustrating a mesh structure of an exemplifying dishware supporting arrangement.

According to FIG. 2*a*, the mesh structure 7 comprises a first plurality of ribs 9 connected to a second plurality of ribs 11. For simplicity only two of the first plurality of ribs 9 and the second plurality of ribs 11 have been marked. The first plurality of ribs 9 is connected to the second plurality of ribs 11 at connection portions 4. Each rib of the first plurality of ribs 9 is connected to at least one other rib of the first plurality of ribs 9 and to at least one of the second plurality of ribs 11. In similar way each of the second plurality of ribs 11 is connected to at least one other of the second plurality of ribs 11 and to at least one of the first plurality of ribs 9.

As illustrated in FIG. 2*a* the first plurality of ribs 9 extends along a first plane n1 and the second plurality of ribs 11 extends along a second plane n2. In other words, the first plurality of ribs 9 extends along the first plane n1 in that the first plurality of ribs 9 extends in directions within the first plane n1 or in directions being parallel to the first plane n1, but at a distance from the first plane n1. In a similar way the second plurality of ribs 11 extends along the second plane n2 in that the second plurality of ribs 11 extends in directions within the second plane n2 or in directions being parallel to the second plane, but at a distance from the second plane n2.

The first plane n1 is arranged at a first angle a1 in relation to the structure main extension plane m2 and the second plane n2 is arranged at a second angle a2 in relation to the structure main extension plane m2. The first angle a1 and the second angle a2 may for example be in a range of 5-45°. The first angle a1 and the second angle a2 may be equal or may be different.

The first plurality of ribs 9 has a first length d1 and the second plurality of ribs 11 has a second length d2. The first length d1 and second length d2 may be equal or may be different. The first length d1 and second length d2 may for example be in a range of 5-200 mm.

Figure 2B:
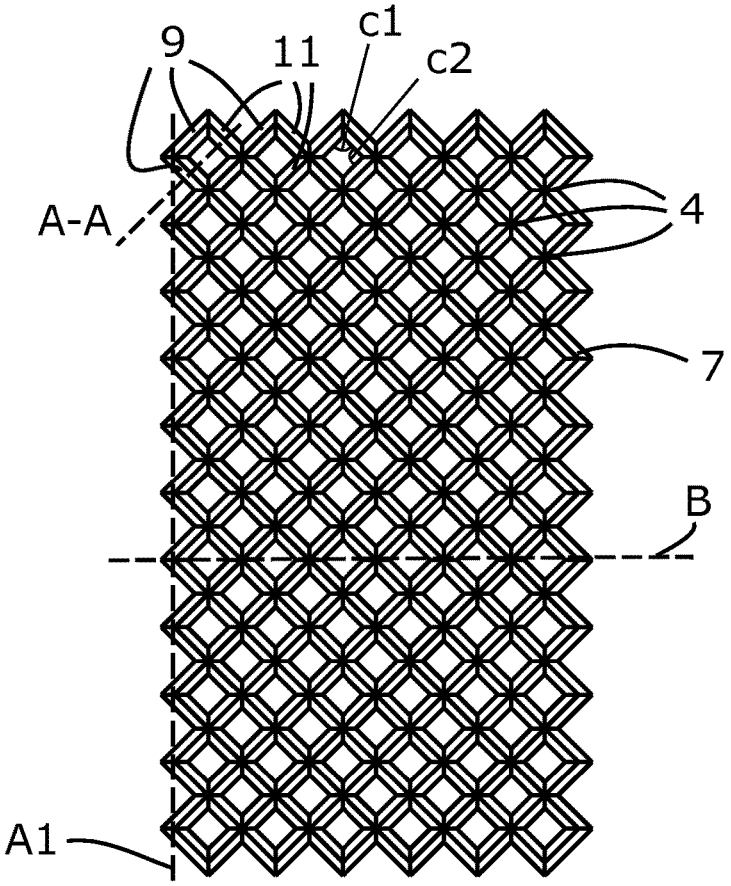
FIG. 2*b* is a top view illustrating the mesh structure in FIG. 2*a*.

FIG. 2*b* illustrates a top view of the mesh structure 7 in FIG. 2*a* and FIG. 1. As can be seen the mesh structure is created by the first plurality of ribs 9 connected to the second plurality of ribs 11 forming squares connected to each other. The first plurality of ribs 9 is connected to the second plurality of ribs 11 at a first rib angle c1. The first plurality of ribs 9 or the second plurality of ribs 11 are connected to each other at a second rib angle c2.

In FIG. 2*b* only angle c2 between two of the second plurality of ribs 11 is illustrated. However, two of the first plurality of ribs 9 may also be connected at an angle with the same value as the second rib angle c2. The first rib angle c1 and the second rib angle c2 may be in a range of 90-150°. According to some embodiments the top view of the mesh structure may have different patterns as for example the first plurality of ribs 9 may be connected to the second plurality of ribs 11 forming rhombs connected to each other. The mesh structure 7 may be rotated around an axis A1. According to the embodiments illustrated in FIG. 2, the axis A1 is arranged along a longer side of the structure 7. However the axis A1 may be positioned at any other positions at the mesh structure 7.

FIG. 3 illustrates a more detailed side-view of the dishware supporting arrangement 1 shown in FIG. 1. As mentioned, the dishware supporting arrangement 1 comprises the tilting mechanism 13, which is arranged to allow the mesh structure 7 to be titled, i.e. rotated around at least one axis A1 between the aforementioned first position p1 and the aforementioned second position p2. The tilting mechanism 13 may comprise a track (not shown) and the mesh structure 7 may comprise a protrusion (not shown) adapted to move along the track. Thus, a user may displace the structure 7 between the first position p1 and the second position p2 e.g. by pulling or pushing by hand at the mesh structure 7. Thereby, the protrusion may be caused to move along the track while the mesh structure 7 tilts, or at least partly rotates, around the axis A1.

Further, the tilting mechanism 13 may be arranged to hold the mesh structure 7 in the first position p1 and in the second position p2 by a first stop mechanism (not shown) arranged to stabilize the mesh structure 7 in the first position p1, and by a second stop mechanism (not shown) arranged to stabilize the mesh structure 7 in the second position p2. The first and second stop mechanisms may be realized by any known stop mechanisms, such as a snap grip or the like.

At the first position p1, the structure main extension plane m2 is arranged at a third angle a3 in relation to the rack main extension plane m1, and at the second position p2 the structure main extension plane m2 is arranged at a fourth angle a4 in relation to the rack main extension plane m1. According to the embodiments illustrated in FIG. 3, the fourth angle a4 is greater than the third angle a3. The third angle may be in a range of 6-45° and the fourth angle a4 may be in a range of 75-90°.

At the first position p1, the mesh structure 7 is arranged to support dishware intended to be washed in the dishwasher. The dishware, such as cups, glasses or silverware, may be placed on the mesh structure 7 at the first position p1 of the mesh structure 7. The mesh structure 7 further comprises a supporting side 15 adapted to support the dishware.

As illustrated in FIG. 3, each of the first plurality of ribs 9 and each of the second plurality of ribs 11 are inclined in relation to the rack main extension plane m1 at the first position p1 and at the second position p2. Thereby, the washing fluid, such as water-drops, flows along the first plurality of ribs 9 and the second plurality of ribs 11 downwards due to gravity which improves draining, i.e. running off of washing fluid from the mesh structure and dishware during a drying phase of a program cycle of a dishwasher. The draining of the washing fluid is improved both in the first position p1 of the mesh structure 7 and at the second position p2. At the second position p2 the mesh structure 7 has been tilted, i.e. rotated around the axis A1 in a direction shown as counter clockwise in relation to the first position p1 in FIG. 3. At the second position p2, the mesh structure 7 is in an idle position, i.e. at the second position p2 the mesh structure is not intended to support any dishware.

According to the embodiments illustrated in FIG. 3, the first angle a1 and the second angle a2 are less than the third angle a3. Thus, each rib of the first plurality of ribs 9 and each rib of the second plurality of ribs 11 are inclined in relation to the rack main extension plane m1 at the first position p1 and at the second position p2 and at all positions between the first position p1 and the second position p2. Alternatively, the first angle a1 and the second angle a2 may be greater than the third angle a3, but still the first angle a1 and the second angle a2 should be different from the third angle a3. Further, the first angle a1 may be less than the third angle a3 and the second angle a2 may be greater than the third angle a3.

Figure 4:
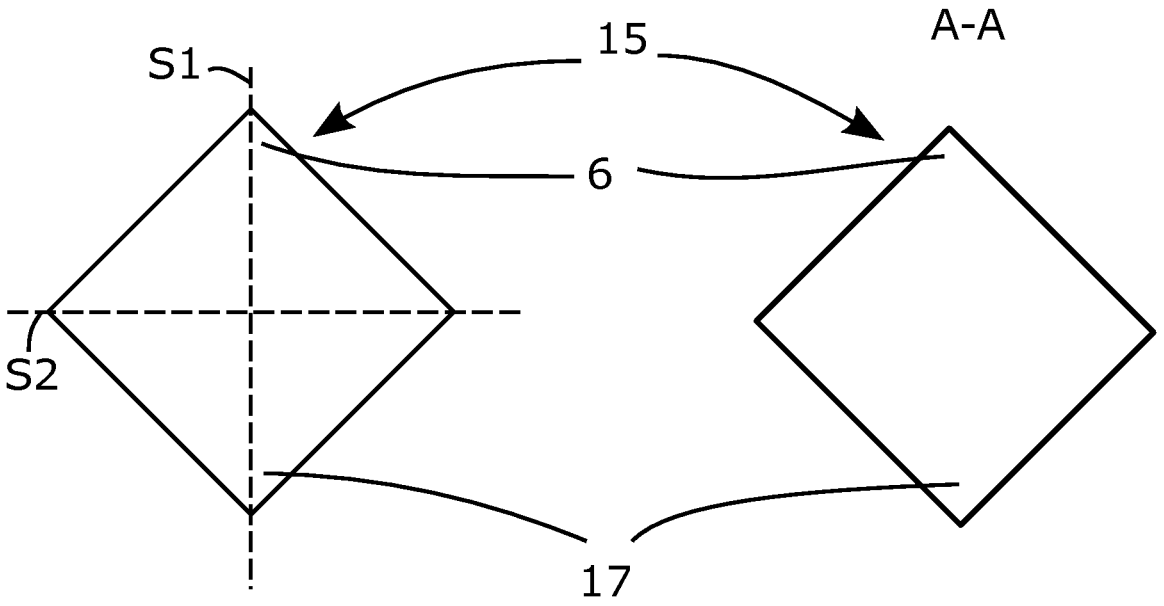
FIG. 4 illustrates a cross section of two ribs of the mesh structure illustrated in FIG. 2*a*, 2*b* and FIG. 3.

FIG. 4 illustrates a cross section of two ribs across a line A-A in FIG. 2*b*. Each of the first plurality of ribs 9 and the second plurality of ribs 11 has a cross sectional profile that may be shaped as a rhomb. Further, the cross sectional profile may be symmetrical or asymmetrical in relation to axis S1 and S2. The first plurality of ribs may have different cross sectional profile than the second plurality of ribs.

Each of the first plurality of ribs 9 and the second plurality of ribs 11 may comprise an upper tip 6. Due to the upper tips 6 of the mesh structure 7, the dishware supported by the mesh structure 7 at the first position have smaller contact area with the mesh structure 7 compared to when the cross sectional profile has an even and substantially horizontal supporting side 15 of the mesh structure 7. By this, draining, i.e. running off, of washing fluid from the dishware and from the mesh structure is facilitated. As an effect drying process of the dishware is improved.

According to some embodiments the cross sectional profile of each of the first plurality of ribs 9 and the second plurality of ribs 11 may comprise a tip 17 pointing opposite to a direction from the support side 15 and away from the support side 15. With other words, opposite in relation to the upper tips 6. Thereby, forces keeping the washing fluid at the ribs are reduced and by this, the draining of the washing fluid from the ribs is improved.

Figure 5:
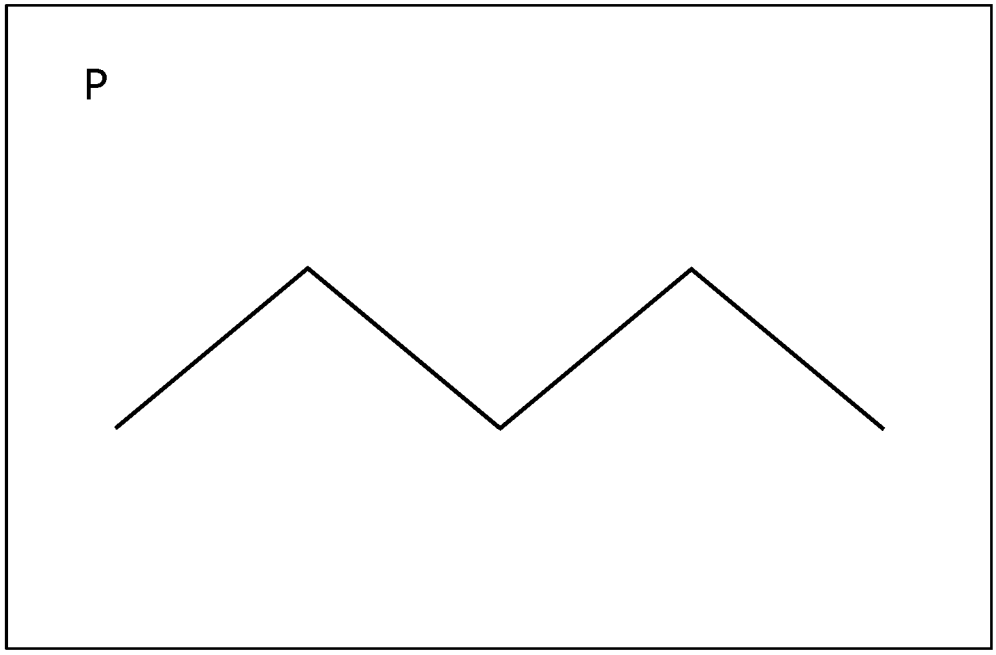
FIG. 5 is a pattern of the mesh structure in FIG. 2*a*, 2*b* and FIG. 3 projected on a plane.

FIG. 5 illustrates a projection of the first plurality of ribs and the second plurality of ribs of the structure onto a plane B perpendicularly orientated with respect to the at least one axis A, which plane B is illustrated in FIG. 2*b*. The projection illustrated in the FIG. 5 forms a zig-zag pattern. In this manner, accommodation of for example knives intended to be washed on the structure is facilitated.

Even though embodiments of the various aspects have been described, many different alterations, modifications and the like thereof will become apparent for those skilled in the art. The described embodiments are therefore not intended to limit the scope of the present disclosure.

The invention claimed is:

1. A dishware supporting arrangement configured to be mounted on a rack of a dishwasher, said rack having a rack main extension plane, wherein said dishware supporting arrangement comprises:

a mesh structure having a structure main extension plane, wherein said mesh structure comprises a first plurality of ribs connected to a second plurality of ribs, wherein said first plurality of ribs extends along a first plane in a first extension direction and said second plurality of ribs extends along a second plane in a second extension direction, wherein said first plane is arranged at a first angle in relation to said structure main extension plane, wherein said second plane is arranged at a second angle in relation to said structure main extension plane, and wherein said mesh structure comprises a supporting side adapted to support said dishware thereon, the supporting side being parallel to said structure main extension plane, and a tilting mechanism arranged to allow said mesh structure to be titled around at least one axis between a first position and a second position, wherein said tilting mechanism is arranged to hold said mesh structure in said first position and in said second position, wherein each of said first plurality of ribs and each of said second plurality of ribs are inclined in relation to said rack main extension plane at said first position and at said second position, and wherein a cross-sectional profile of each of said first plurality of ribs taken in a plane perpendicular to the first extension direction and of each of said second plurality of ribs taken in a plane perpendicular to the second extension direction comprises a tip pointing opposite to a direction from said supporting side and downward when said mesh structure is in said first position.

2. The dishware supporting arrangement according to claim 1, wherein at said first position said structure main extension plane is arranged at a third angle in relation to said rack main extension plane and wherein at said second position said structure main extension plane is arranged at a fourth angle in relation to said rack main extension plane, and wherein said fourth angle is greater than said third angle.

3. The dishware supporting arrangement according to claim 2, wherein said first angle and said second angle are less than said third angle.

4. The dishware supporting arrangement according to claim 1, wherein at said first position said mesh structure is arranged to support dishware.

5. The dishware supporting arrangement according to claim 1, wherein said cross sectional profile is shaped as a rhomb.

6. The dishware supporting arrangement according to claim 1, wherein said mesh structure comprises a plastic material.

7. The dishware supporting arrangement according to claim 1, wherein a projection of said first plurality of ribs and said second plurality of ribs onto a plane perpendicularly orientated with respect to said at least one axis is described by a zig-zag pattern.

8. A dishwasher comprising a dishware supporting arrangement according to claim 1.

9. The dishware supporting arrangement according to claim 1, wherein the cross-sectional profile of each of said first plurality of ribs taken in the plane perpendicular to the first plane and of each of said second plurality of ribs taken in the plane perpendicular to the second plane comprises a support side tip pointing in a direction to said supporting side.

10. The dishware supporting arrangement according to claim 1, wherein the supporting side comprises a support surface comprising the support side tip of each of said first plurality of ribs and of each of said second plurality of ribs.

11. A dishware supporting arrangement configured to be mounted on a rack of a dishwasher, said rack having a rack main extension plane, wherein said dishware supporting arrangement comprises:

a mesh structure having a structure main extension plane, wherein said mesh structure comprises a first plurality of ribs connected to a second plurality of ribs, wherein:

said first plurality of ribs extends along a first plane and said second plurality of ribs extends along a second plane, said first plane is arranged at a first angle in relation to said structure main extension plane, said second plane is arranged at a second angle in relation to said structure main extension plane, each rib of the first plurality of ribs and the second plurality of ribs defining a respective extension direction between opposite distal ends of the rib, with a first rib of the first plurality of ribs connected to a second rib of the second plurality of ribs at their respective distal ends, said mesh structure comprises a supporting side adapted to support said dishware thereon, said supporting side being parallel to the respective extension directions of the first plurality of ribs and the second plurality of ribs, and a cross-sectional profile of each rib of the first plurality of ribs and the second plurality of ribs taken in a plane perpendicular to the respective extension directions comprises a tip pointing opposite a direction from said supporting side and away from said supporting side; and a tilting mechanism arranged to allow said mesh structure to be titled around at least one axis between a first position and a second position, wherein said tilting mechanism is arranged to hold said mesh structure in said first position and in said second position, wherein each of said first plurality of ribs and each of said second plurality of ribs are inclined in relation to said rack main extension plane at said first position and at said second position.

* * * * *